United States Patent [19]

Miyazaki

[11] 3,982,634

[45] Sept. 28, 1976

[54] METHOD AND APPARATUS FOR ERECTING A VERTICAL STRUCTURE

[75] Inventor: Moritugu Miyazaki, Tokyo, Japan

[73] Assignee: Mitsui Shipbuilding and Engineering Co., Ltd., Tokyo, Japan

[22] Filed: July 16, 1975

[21] Appl. No.: 596,573

Related U.S. Application Data

[63] Continuation-in-part of Ser. No. 417,912, Nov. 21, 1973, abandoned.

[30] Foreign Application Priority Data

Nov. 29, 1972 Japan ..... 47-120138

[52] U.S. Cl. ..... 212/1; 214/95 R; 212/144; 212/71; 212/10

[51] Int. Cl.[2] ..... B66C 15/06

[58] Field of Search ..... 212/17, 28, 35, 57, 212/64, 144, 10, 1, 71, 124

[56] References Cited

UNITED STATES PATENTS

| | | | |
|---|---|---|---|
| 3,080,981 | 3/1963 | Kuschel | 212/28 |

FOREIGN PATENTS OR APPLICATIONS

| | | | |
|---|---|---|---|
| 262,893 | 6/1968 | Austria | 214/16.4 B |
| 1,076,799 | 10/1954 | France | 212/64 |
| 1,091,724 | 10/1960 | Germany | 212/64 |

*Primary Examiner*—Robert J. Spar
*Assistant Examiner*—R. B. Johnson
*Attorney, Agent, or Firm*—Stanley B. Kita

[57] ABSTRACT

Climbing crane for construction characterized in that a superstructural portion of the climbing crane is removably fixed on the tower, the superstructural portion provided with a travelling device for moving on the built structure.

2 Claims, 8 Drawing Figures

METHOD AND APPARATUS FOR ERECTING A VERTICAL STRUCTURE

This application is a continuation-in-part of copending application Ser. No. 417,912 filed on Nov. 21, 1973, now abandoned for Climbing Crane For Construction.

The present invention relates to a climbing crane for a construction.

Conventional types of climbing cranes for construction are classified into two groups, a fixed type and a travelling type. The former, that is the fixed climbing crane, has the disadvantages that the range of working is restricted to within the turning radius (about 30 meters in maximum), and that the suspension load becomes remarkably smaller as the outreach is increased. The travelling climbing crane, on the other hand, is of the self-supporting type, and incurs a considerable expense in the construction of a travelling railway and its foundation or a travelling road in the case of the tire or caterpillar type. Besides, it has the further disadvantages that both the truck and the tower are increased in their sizes, thus giving rise to the increased cost and inconvenience in transportability.

In consideration of the above-mentioned situation, it is the object of this invention to provide a crane which may rationalize to construct a large-scale structure.

According to the present invention, the crane is so constructed that the superstructure of the crane can be separated from the tower portion and transferred to the uppermost portion of the partially completed structure. Thus, the remaining work of the structure is carried out successively by using the transferred superstructure portion.

The present invention will now be described, by way of example with reference to the accompanying drawings, in which.

Figure 1:
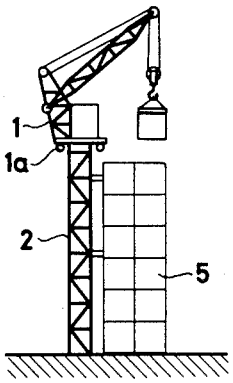
FIGS. 1 to 3 are schematic front views illustrating the working process for constructing a large-scale structure by using the climbing crane for construction according to the present invention.
Figure 2:
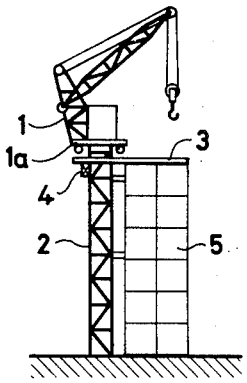
Figure 3:
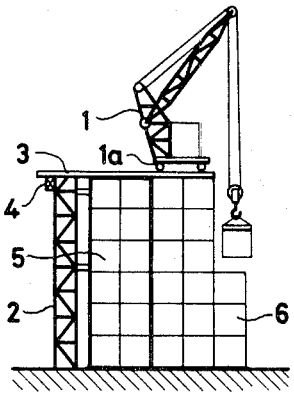
Figure 6:
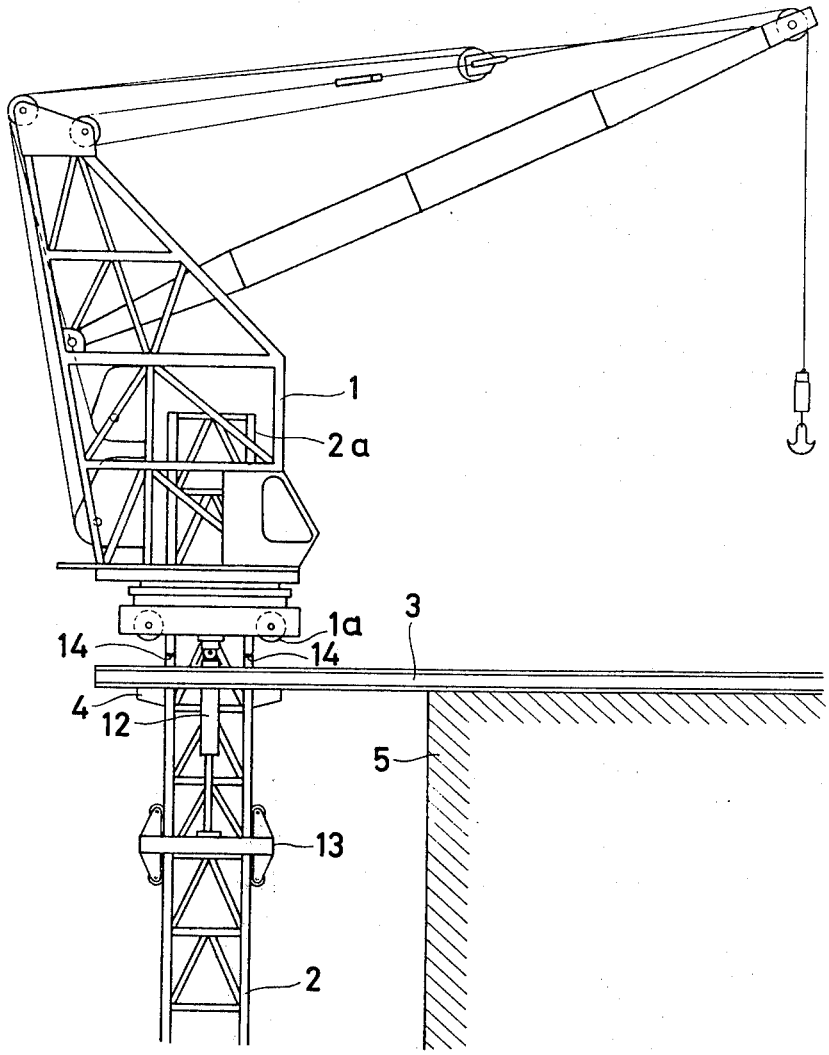
FIG. 6 is a front view of an example of climbing crane.
Figure 7:
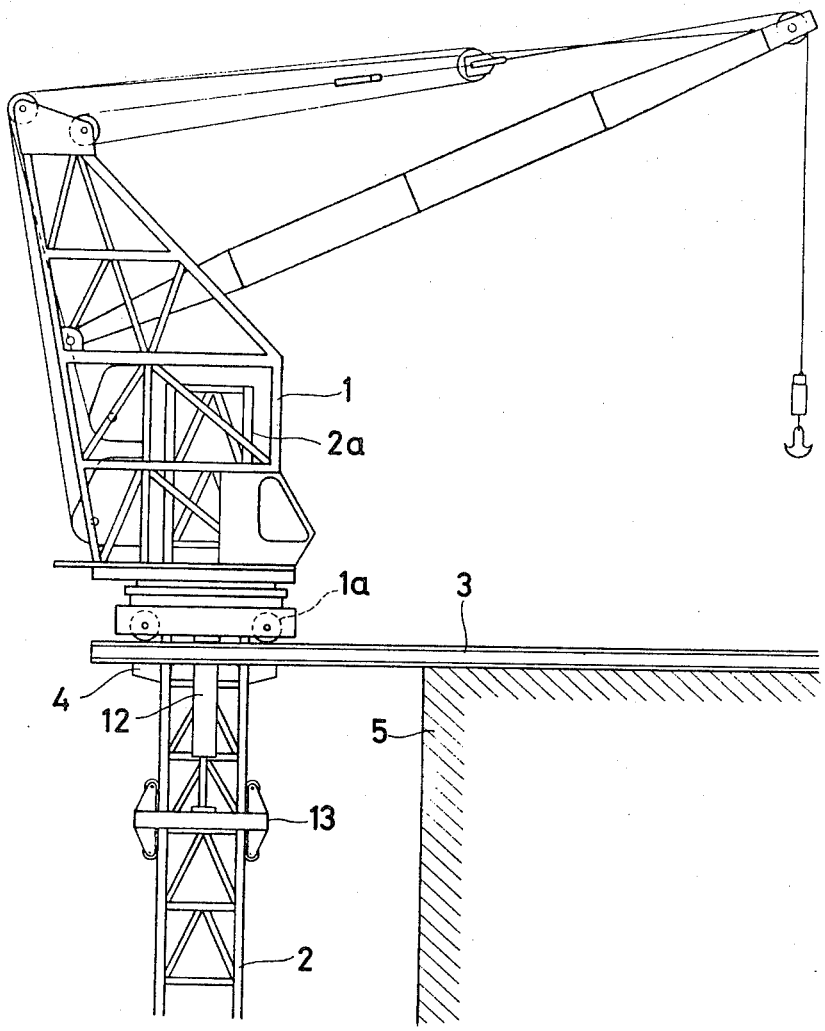
FIGS. 7 and 8 are illustrations showing removing operation of the superstructure of the climbing crane.
Figure 8:
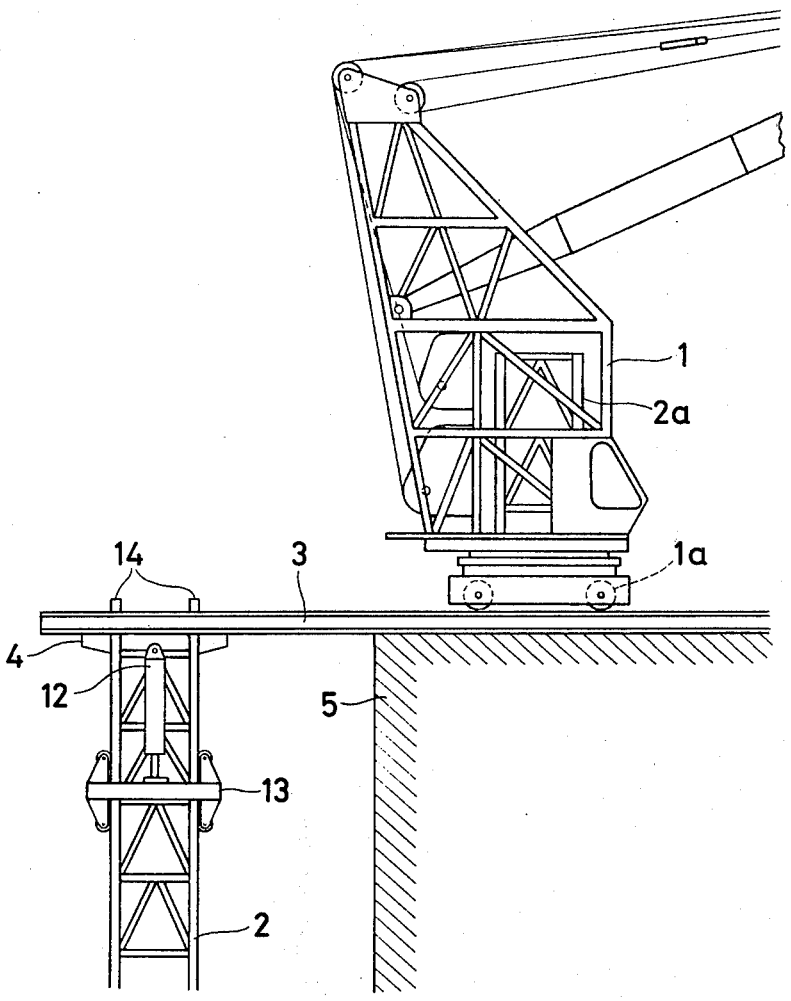

Referring to FIGS. 1 and 6, reference numeral 1 designates a superstructural portion of a climbing crane, the portion comprising a jib crane having a travelling device 1*a* according to the present invention, oil hydraulic cylinder 12 and lower portion 13 connected to the piston rod of the cylinder 12. Said superstructural portion 1 is adapted to be capable of climbing the tower 2 by alternative operation of the oil hydraulic cylinder 12 and locking means provided in the portions 1 and 13. When a large-scale structure is constructed by using the crane according to this invention, component parts of the structure 5 are superimposed to complete the structure within the outreach of the crane, while the superstructural portion 1 climbs the tower 2 by means of the said climbing device, as shown in FIG. 1. Then, as shown in FIG. 2, rail 3 for transferring the crane is laid over between the tower 2 and the structure 5 and interconnected with the tower 2 by means of a rail support beam 4. Thereafter, the lower portion 13 is secured to the tower 2 by the locking means and the superstructural portion 1 is lowered by operation of the cylinder 12, so that the portion 1 is placed on the rail 3 as shown in FIG. 7. Then, the upper portion 2*a* of the tower 2 is separated from the tower 2 at 14 and cylinder 12 is separated from the portion 1, and the superstructural portion 1 is secured to the upper portion 2*a*. Thereafter the superstructural portion 1 is transferred onto the structure 5 by the travelling device 1*a* together with the upper portion 2*a* as shown in FIG. 8. Then, the remaining component structure 6 is completed by manipulation of the superstructural portion 1 of the crane as the superstructural portion 1 successively travels on the component structures 5 and 6, as shown in FIG. 3, so that the whole structure is completed. After finishing the work, the superstructural portion is returned to the tower 2, and the rail 3 and the rail supporting beam 4 are removed, thereafter the superstructural portion is lowered along the tower 2 by means of the climbing device.

Figure 4:
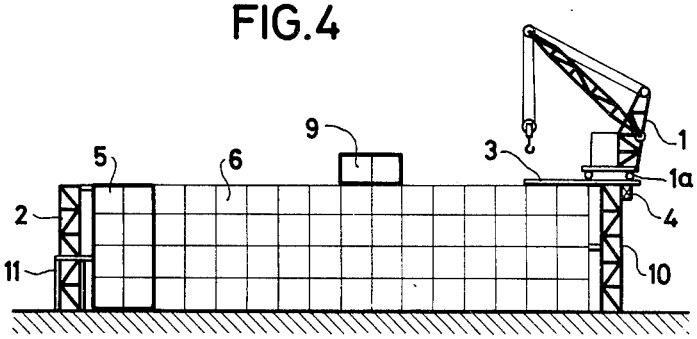
FIG. 4 is a similar view showing the working process in which the superstructural portion of the crane cannot be returned to the tower by travelling on the structure.

When the structure has a projecting portion 9 on the top thereof as shown in FIG. 4, the superstructure cannot be returned to the tower 2. In this case, a lowering device 11 is provided on the tower 2 and, by raising and lowering this lowering device 11 the tower 2 is dismantled from the upper portion. After dismantling, the tower is transferred to the opposite side of the structure, and reassembled there into a tower 10 by the superstructural portion 1. Thus, the superstructural portion can be lowered by climbing device.

Figure 5:
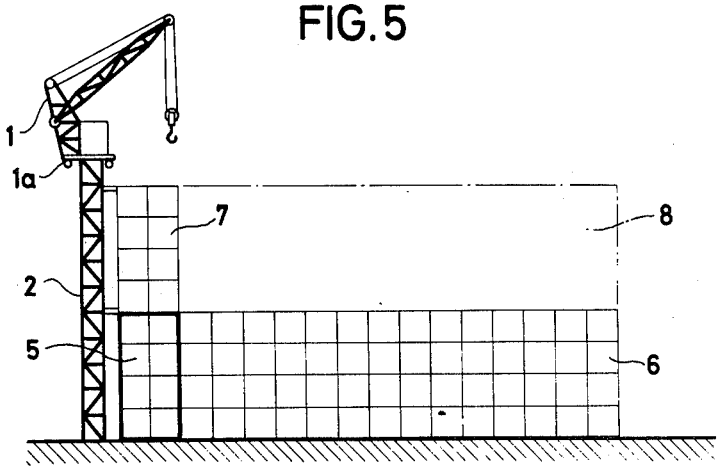
FIG. 5 is a similar schematic front view showing the working sequence for piling up the structures into an enormous high-rise structure.

FIG. 5 illustrates a case of constructing a tall structure. In this case, the relatively short component structures 5 and 6 having the height allowable in strength are assembled, as shown in FIGS. 1, 2 and 3. Thereafter, the superstructural portion 1 of the crane is returned to the tower 2 and manipulated for constructing a component structure 7, while climbing again said tower 2 by means of the climbing device. Then, as mentioned above, the superstructural portion 1 of the crane is separated from the tower 2, and made to travel on said structure 7 for constructing the component structure 8, thereby completing the whole structure.

As compared with conventional types of climbing cranes, the climbing crane according to this invention has the following advantages.

1. In the case of a large-scale structure, even only one set of the crane is capable of efficiently constructing said structure, without disassembling, transferring and reassembling.

2. Comparing with a travelling climbing crane, the tower is lighter in weight, and no travelling truck is required.

3. The reverse space for the outer structure and the foundation works as necessary in the case of travelling cranes may be omitted.

4. Since the jib may be shortened, it can be made smaller and lighter, thereby suspension load may be increased.

What is claimed is:

1. Apparatus for use in completing the erection of a structure partially-erected to a level, comprising:

a temporary tower projecting upwardly alongside the partially-erected portion of the structure to a location above said level, said tower having an upper section above said level, a lower section below said level, and means releasably connecting said upper and lower sections to afford lateral disengagement of one from the other;

a superstructure assembly transferable onto said partially-erected structure for use thereon, said superstructure assembly including:

a jib crane, tower climbing means carried by said jib crane for engaging the tower to advance said crane vertically therealong, and traveling means supporting said crane for movement horizontally along a surface; said tower climbing means including upper tower locking means, lower tower locking means below said upper tower locking means, extensible linkage means projecting upwardly toward said superstructure assembly from said lower tower locking means; and means releasably securing said extensible linkage means to said superstructure assembly; and horizontally-disposed rail means supported by said lower section of said tower and by said partially-erected structure for providing a temporary bridge across said tower and said structure at said level and providing said support surface for said crane traveling means;

whereby the upper section of the tower can be separated from the lower section thereof and moved laterally with the superstructure assembly on the rail means onto the partially-erected structure to enable the jib crane to be used to complete the erection of the structure.

2. A method of completing erection of a structure partially-erected to at least one level with apparatus including a plurality of tower sections; means releasably connecting said sections to afford lateral separation of one from the other; a superstructure assembly including a jib crane having tower climbing means and traveling means, bridging means eagageable by the traveling means of the jib crane, said climbing means including upper tower locking means, lower tower locking means, and extensible linkage means projecting upwardly from the lower tower locking means; and means releasably fastening said linkage means to said superstructure assembly; said method comprising the steps of:

erecting alongside the partially-erected structure a temporary tower composed of said built-up sections with at least one of the sections projecting upwardly beyond the partially-erected level of the structure;

sequentially actuating the upper tower locking means, the lower tower locking means and the extensible linkage means to raise the superstructure assembly upwardly on the tower above said level;

fastening the bridging means to the tower below said one section and supporting the bridging means on the partially-erected structure at said level;

actuating said extensible means to lower the superstructure assembly relative to the upper section of the tower and to dispose the jib crane traveling means on the bridging means;

disconnecting said one section of the tower from the tower sections therebelow;

disconnecting the fastening means; and advancing the jib crane by its traveling means across the bridging means onto the partially-erected structure while carrying the upper section of the tower therewith.

* * * * *